US007062891B2

(12) United States Patent
Krüger et al.

(10) Patent No.: US 7,062,891 B2
(45) Date of Patent: Jun. 20, 2006

(54) BOX-CLOSING APPARATUS

(75) Inventors: Andreas Krüger, Donaurieden (DE); Norbert Demler, Simmerberg (DE); Armin Stibe, Heimenkirch (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 10/962,983

(22) Filed: Oct. 12, 2004

(65) Prior Publication Data

US 2005/0081486 A1 Apr. 21, 2005

(30) Foreign Application Priority Data

Oct. 13, 2003 (DE) ..... 103 47 520

(51) Int. Cl.
*B65B 7/00* (2006.01)

(52) U.S. Cl. ..... 53/376.5; 53/377.3

(58) Field of Classification Search ..... 53/484, 53/491, 376.3, 376.5, 376.8, 377.3
See application file for complete search history.

(56) References Cited

U.S. PATENT DOCUMENTS

| | | | | | |
|---|---|---|---|---|---|
| 930,090 | A | * | 8/1909 | Scales | 53/376.5 |
| 1,803,633 | A | * | 5/1931 | McCain | 53/377.3 |
| 2,324,443 | A | * | 7/1943 | Walter | 53/377.3 |
| 2,628,466 | A | * | 2/1953 | Brown | 53/377.3 |
| 2,693,671 | A | * | 11/1954 | Geisler | 53/377.3 |
| 3,442,063 | A | | 5/1969 | Martin | |
| 3,452,514 | A | * | 7/1969 | Harkness | 53/377.3 |
| 4,480,421 | A | * | 11/1984 | Rece | 53/376.5 |
| 4,673,381 | A | * | 6/1987 | Yamamoto et al. | 53/376.5 |
| 4,894,104 | A | * | 1/1990 | Hemus | 53/376.5 |
| 4,951,445 | A | * | 8/1990 | Thibault | 53/376.3 |
| 5,188,695 | A | * | 2/1993 | Colton | 53/377.3 |
| 5,341,621 | A | | 8/1994 | Martelli | |
| 5,369,933 | A | | 12/1994 | Waldstadt | |

FOREIGN PATENT DOCUMENTS

| | | |
|---|---|---|
| DE | 199 18 940 | 11/2000 |
| DE | 100 65 310 | 7/2002 |
| EP | 0576404 | 12/1993 |

* cited by examiner

*Primary Examiner*—Louis Huynh
(74) *Attorney, Agent, or Firm*—Andrew Wilford

(57) ABSTRACT

A box-closing apparatus has a hanger link having one end pivoted about a fixed link axis on a stationary housing adjacent a station holding a box blank and another end defining a movable link axis. A two-arm main lever pivoted generally centrally at the movable link axis on the link has a pusher arm extending from the movable link axis and carrying a pusher block engageable with the flap of the box blank in the station and an actuating arm extending from the movable link axis and having an outer end. A drive lever pivoted at a fixed drive axis on the housing has an outer end pivoted at an outer drive axis on the outer end of the actuating arm of the main lever. The pusher block moves generally through a 0°–90° sinusoidal trajectory to press an outer flap against a glue flap of the blank in the station.

12 Claims, 7 Drawing Sheets

BOX-CLOSING APPARATUS

FIELD OF THE INVENTION

The present invention relates to a box-closing apparatus. More particularly this invention concerns an apparatus that presses a flap at a side of a box against a strip at the same side to adhere the flap to the strip and close this side of the box.

BACKGROUND OF THE INVENTION

In a box-erecting or packaging operation as described in German patent publication 100 65 310 of R. Stahn a flattened box blank is typically pushed into a tubular three-dimensional having two oppositely open sides from each of which several flaps extend. Then two flaps at one of the open sides are folded in and pressed together, normally after applying a contact adhesive to that face of one of the flaps that bears against the other flap, typically the outer face of the inner flap. This creates a stable three-dimensional box that can be tipped up on the now closed side formed by the glued-together flaps, and then filled through the other side that is upwardly open.

Other apparatuses for folding in and gluing flaps are described in German patent publication 1j99 18 940 of R. Ruf and U.S. Pat. No. 5,369,933 of M. Waldstädt. These devices are all fairly complex. None of them allows a flap to be pivoted gently from a position projecting outward through a box through 90° to a position bearing against the glue strip of the box by a relatively simple mechanism. Furthermore changing the operation of the box-closing apparatus to accommodate a box of different size is very difficult with the prior-art machines.

OBJECTS OF THE INVENTION

It is therefore an object of the present invention to provide an improved box-closing apparatus.

Another object is the provision of such an improved box-closing apparatus that overcomes the above-given disadvantages, in particular that can swing in and press down a box flap using a relatively simple apparatus that can be easily reset for boxes of different sizes.

SUMMARY OF THE INVENTION

An apparatus for pressing an outer flap of a box blank against a glue flap of the blank has according to the invention a housing adapted to support the box blank in a closing station and a hanger link having one end pivoted about a fixed link axis on the housing adjacent the station and another end defining a movable link axis. A two-arm main lever pivoted generally centrally at the movable link axis on the link has a pusher arm extending from the movable link axis and carrying a pusher block engageable with the flap of the box blank in the station and an actuating arm extending from the movable link axis and having an outer end. A drive lever pivoted at a fixed drive axis on the housing has an outer end pivoted at an outer drive axis on the outer end of the actuating arm of the main lever. The axes all is generally parallel, and a drive oscillates the drive lever about the fixed drive axis and thereby moves the pusher block generally through a 0°–90° sinusoidal trajectory between an upper point above and spaced horizontally from the blank in the station and a lower point pressing the outer flap against the glue flap of the blank in the station.

The main lever carrying the pusher block is able to describe the sinusoidal movement because it is carried on two axes that each oscillate about a respective fixed axis. This makes it possible to convert a simple oscillation of the drive lever about the fixed drive axis into a downward and inward movement of the pusher block, so that the projecting box flap is first pivoted down and then pressed horizontally against the glue flap.

The pusher block according to the invention has a rounded edge engageable with the outer flap of the box in the station. In addition it has a width generally equal to a width of the outer flap. Thus it will not damage the flap and will press it against the box's glue strip along its full length.

The fixed link axis is above the movable link axis and the fixed drive axis is below the outer drive axis. Thus the weight of the main lever in part is responsible for its sinusoidal downward movement on pivoting of the hanger link towrd the box blank.

In accordance with the invention an applicator lever pivoted about an applicator-lever axis on the housing serves for applying glue to the glue flap. The drive is coupled to the applicator lever to pivot it about the applicator-lever axis synchronously with pivoting of the drive lever about the fixed drive axis. Thus the applicator lever swings up and simultaneously pushes in the glue flap and applies a line of adhesive to it, then drops back out of the way as the pusher block presses the outer flap against the glue flap.

The drive has a cam with a pair of cam formations respectively connected to the drive lever and applicator lever. The cam is pivotal about a cam axis and one of the cam formations is a radially open annular groove coupled to the drive lever. The drive lever has an arm projecting from the fixed drive axis and the drive includes a cam follower riding in the respective cam formation and fixable at any of a plurality of locations along the drive-lever arm. Simply relocating the attachment location of this cam follower along this arm changes the lever arm through which the cam is effective on the drive lever and thus changes the vertical stroke of the pusher block, mainly by raising or lowering its uppermost point.

Another of the cam formations is an axially open groove coupled to the applicator lever, typically via a pivotal link lever. The drive can also include a variable-stroke linear servomotor connected to the drive lever and/or to the applicator lever.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
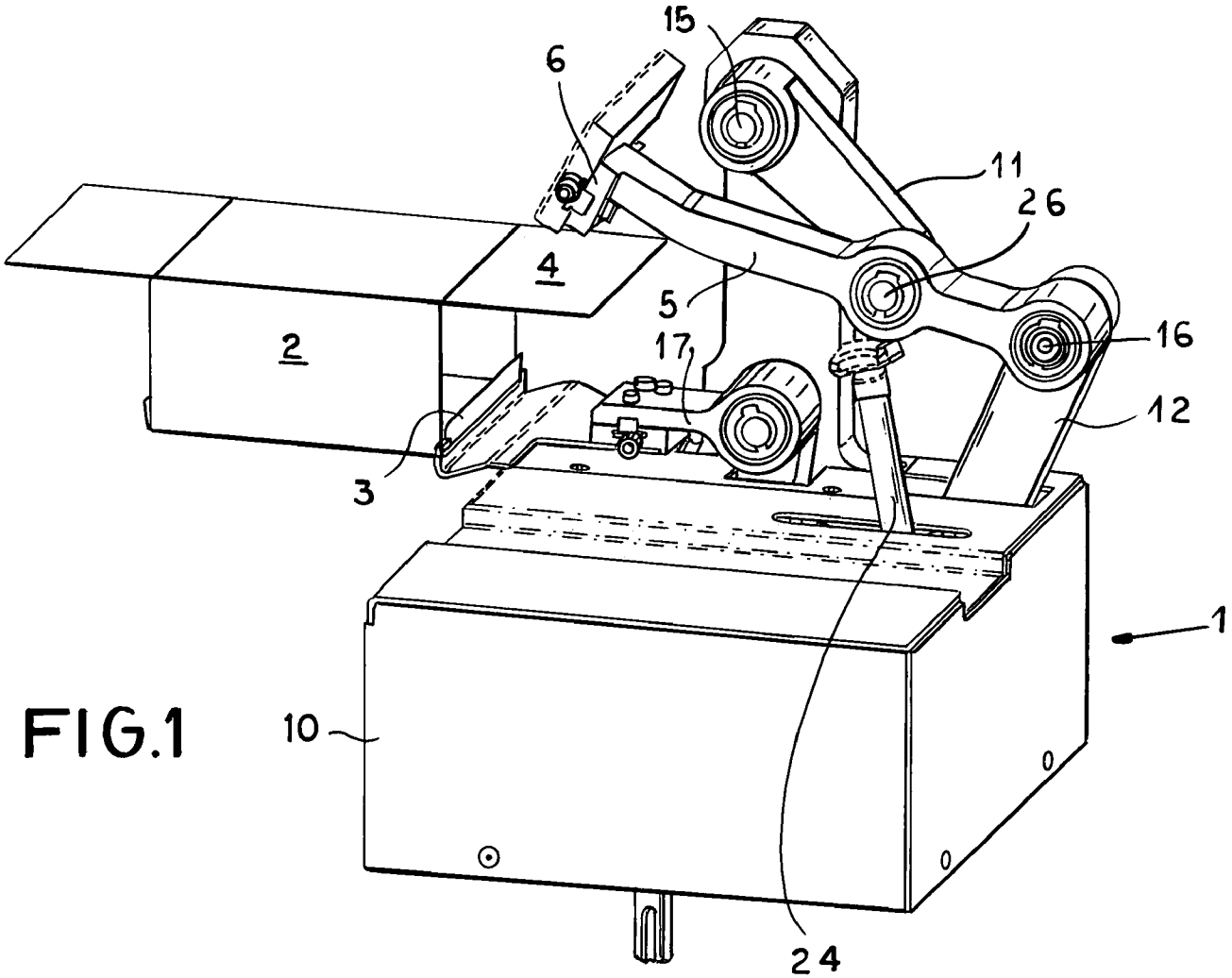
FIG. 1 is a small-scale perspective view of the apparatus according to the invention.
Figure 2:
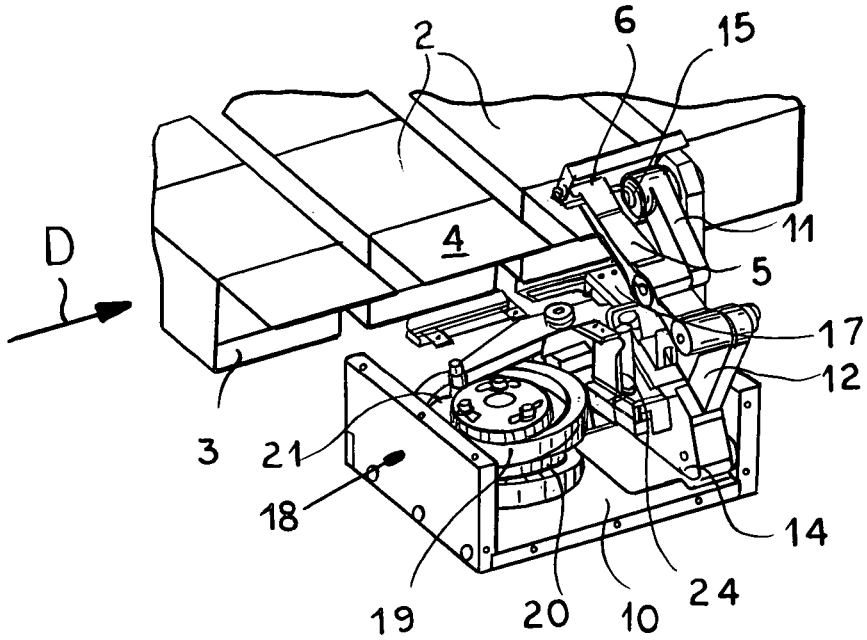
FIG. 2 is a perspective view of a detail of the apparatus.

As seen in FIGS. 1, 2, 3, and 4, an apparatus 1 for folding a flap 4 of a box blank 2 against a glue-covered flap 3 of the blank 2 has a stationary housing 10 past which the boxes 2 are moved in a horizontal transport direction D (FIG. 2), stopping in a treatment station on the housing 10. The apparatus 1 has a main two-arm lever 5 pivoted centrally at 26 at a lower end of a swing link 11 pivoted at an upper axis 15 fixed on a post of the housing 10. An outer end of this lever 5 carries a flap-pushing block 6 which has a width in the direction D generally equal to that of the flap 4. An inner end of the lever is pivoted at 16 at the upper end of another lever 12 whose lower end is pivoted at 14 in the housing 10. The axes of the pivots 14, 15, 16, and 26 are all parallel to each other and to the direction D. In addition a two-arm glue-applying lever 17 is pivoted on the housing 10 at 27 directly below the pivot 15 and has an outer arm engageable with the flap 3 to apply glue to it.

A common drive 18 oscillates the lever 12 about its axis 14 and the lever 17 about its axis 27. This drive 18 has a continuously rotating cam wheel 19 centered on a vertical axis and formed with a horizontally and radially open cam groove 20 and with an axially upwardly open cam groove 21. A cam follower 23 engaged in the cam groove 20 is shiftable along an arm 22 of the lever 22 and lockable at any position therealong by an adjustment rod 24. The further from the axis 14 the cam follower 23 is fixed to the arm 22, the shorter the vertical movement of the pusher block 6. A cam-follower link 13 connects the cam 21 with the glue-applicator lever 17 so that same rises up to apply glue to the flap 3 and fold it in, then drop back down out of the way before the pusher block 6 pivots down the outer flap 4 and presses it against the flap 3.

Figure 10:
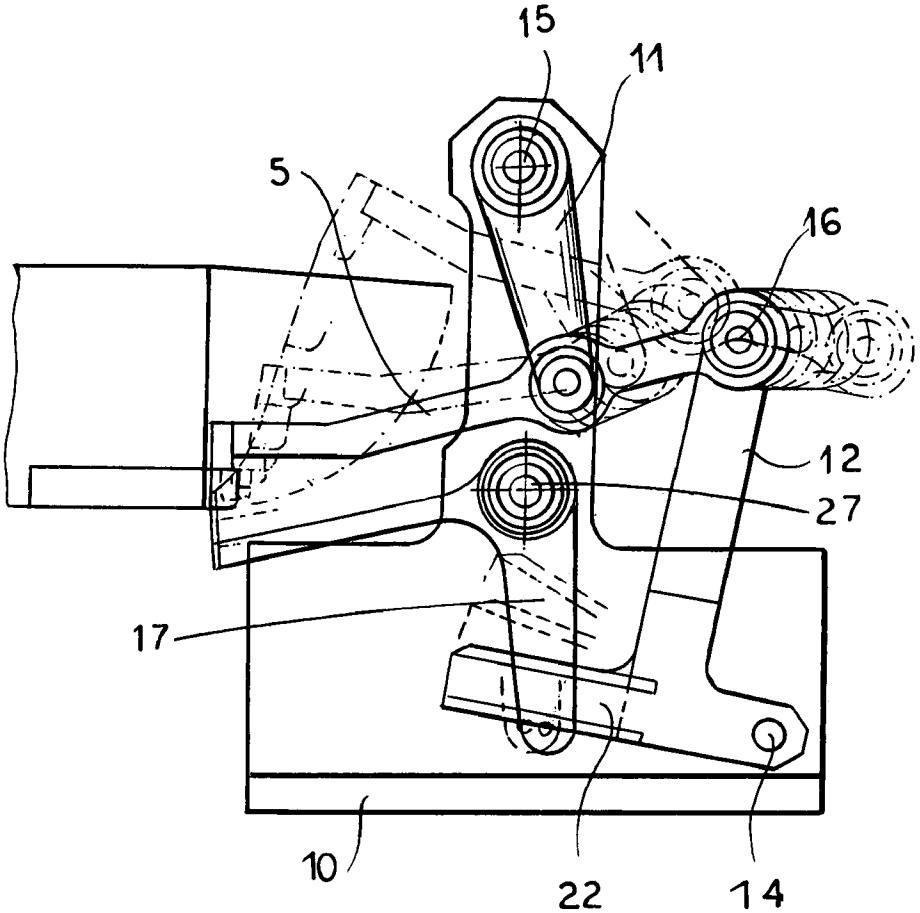
FIG. 10 is a side view illustrating the kinematics of the system of FIGS. 1 to 8.

The kinematics are such that the pusher block 6 describes a 0°–90° sinusoidal trajectory 9 between an upper point 7 and a lower point 8 as it pushes the flap 4 down and then in. This movement is created by arcuate orbiting of the central pivot 26 of the lever 4 about the pivot axis 15 and synchronous arcuate orbiting of its rear-end pivot 16 about the axis 14. It is shown in dashed lines in FIG. 10.

Figure 9:
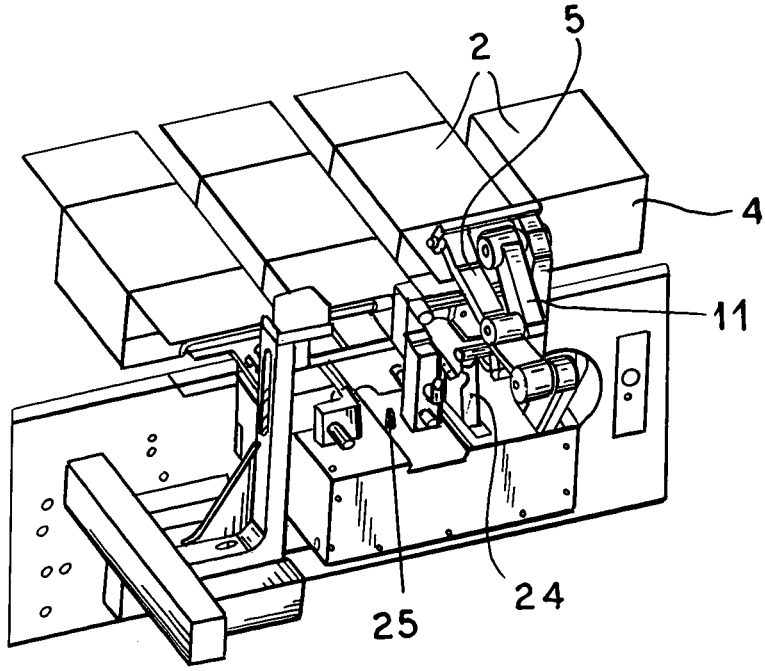
FIG. 9 is a view like FIG. 2 of an alternative drive for the instant invention.
Figure 3:
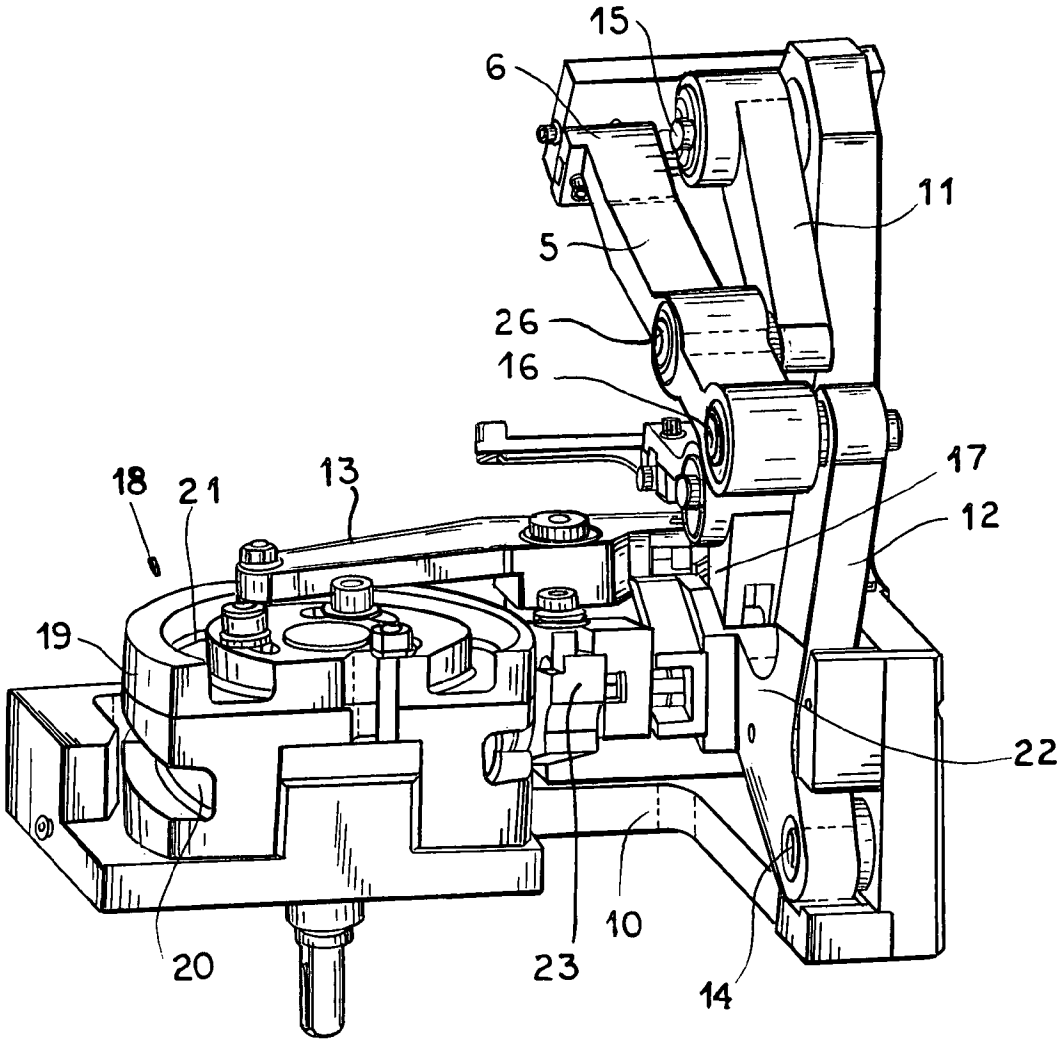
FIGS. 3 and 4 are perspective views of a detail of the structure shown in FIG. 2.
Figure 4:
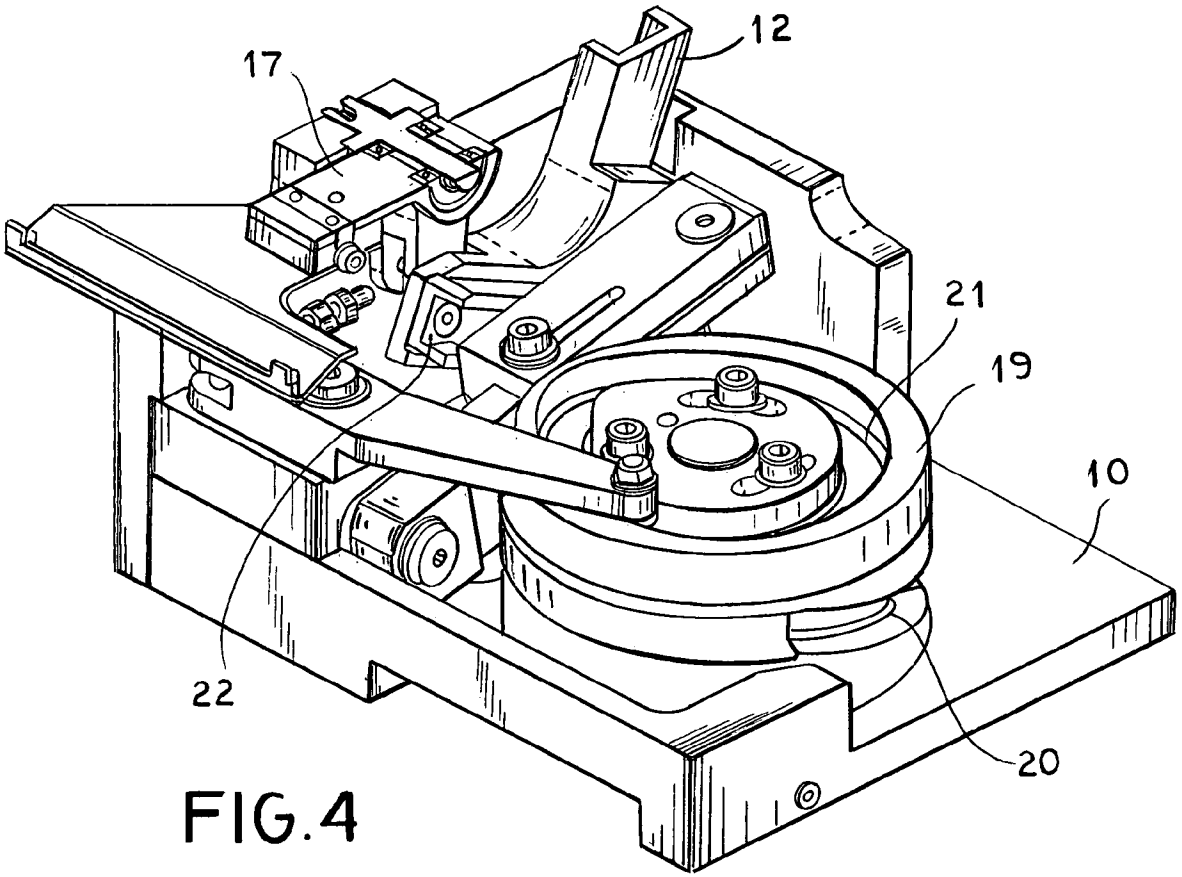
Figure 5:
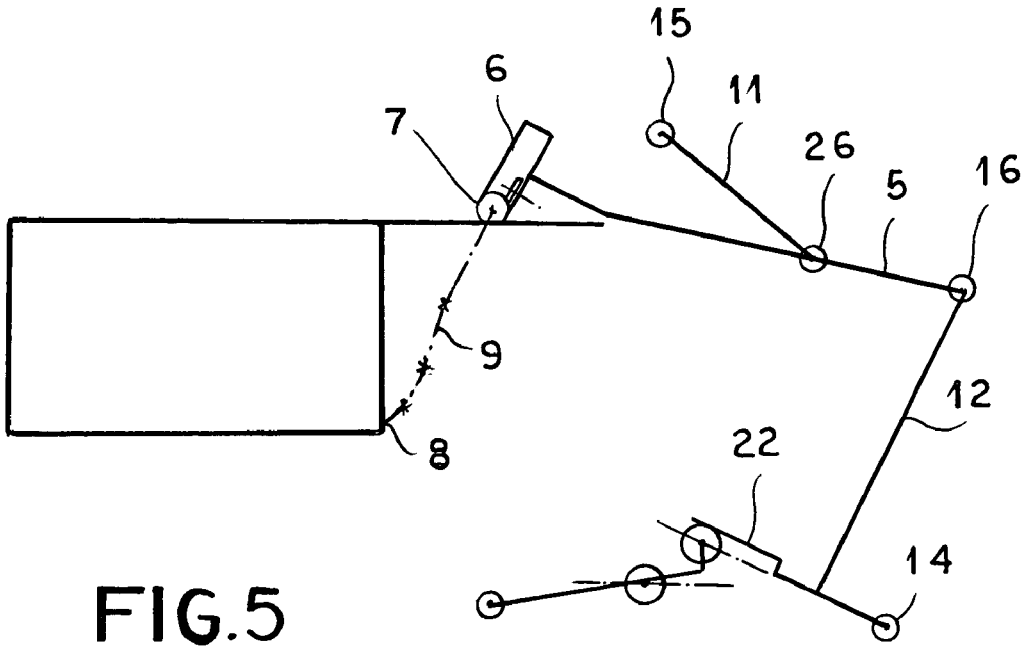
FIGS. 5 through 8 are diagrammatic views illustrating the operation of the apparatus in accordance with the invention.
Figure 6:
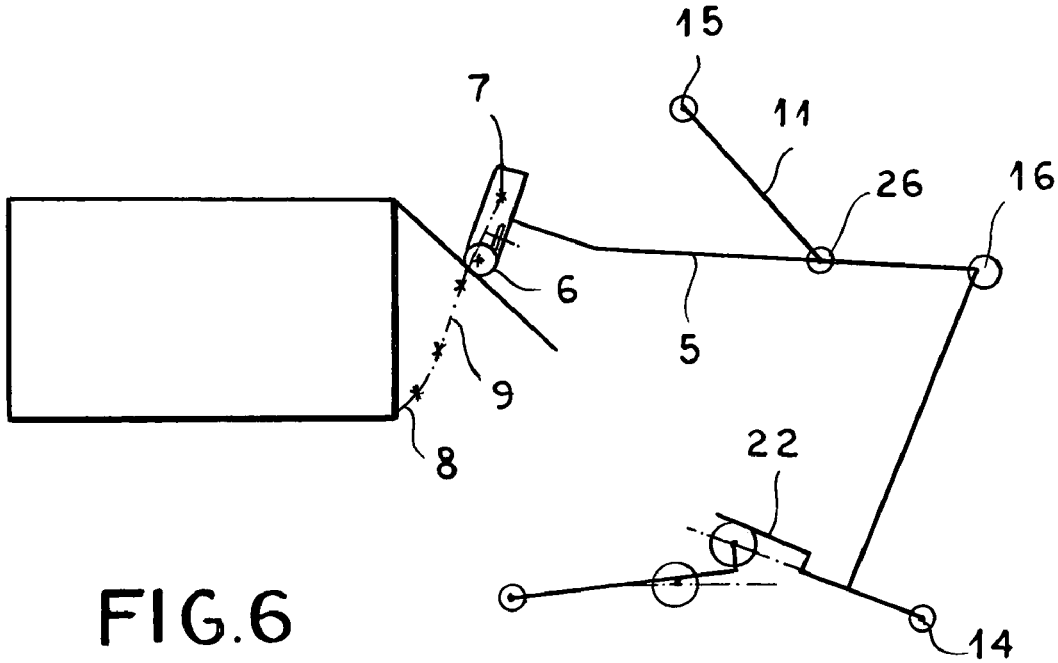
Figure 7:
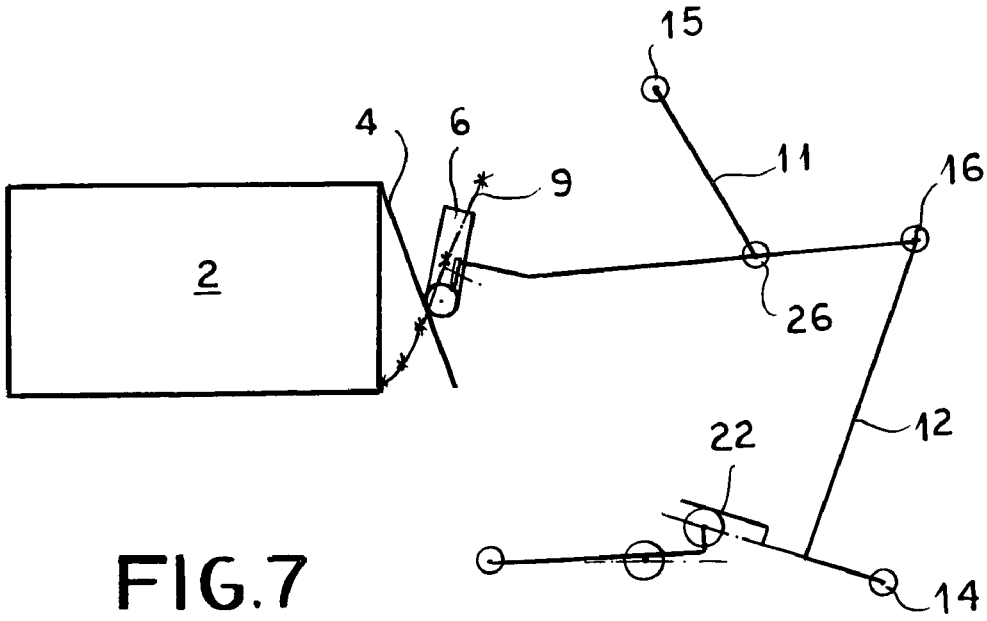
Figure 8:
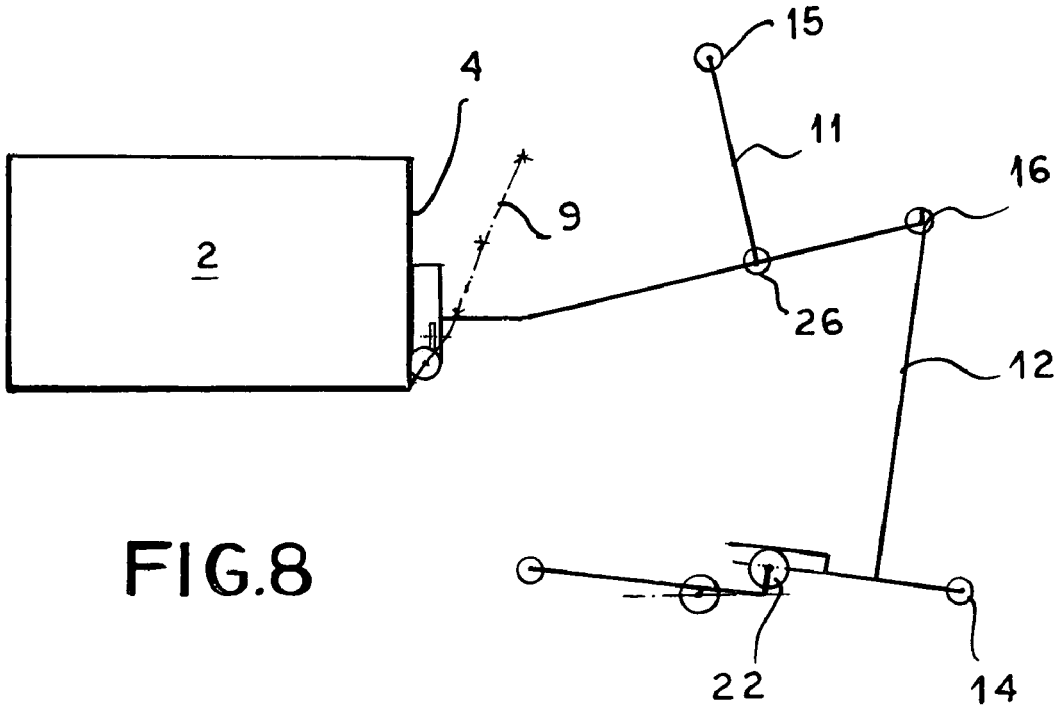

Alternately as shown in FIG. 9, a variable-stroke linear servomotor or drive 25 can be connected to the levers 12 and 17 to operate them.

We claim:

1. An apparatus for pressing an outer flap of a box blank against a glue flap of the blank, the apparatus comprising:

a housing adapted to support the box blank in a closing station;

a link having one end pivoted about a fixed link axis on the housing adjacent the station and another end defining a movable link axis;

a two-arm main lever pivoted generally centrally at the movable link axis on the link and having a pusher arm extending from the movable link axis and carrying a pusher block engageable with the outer flap of the box blank in the station and an actuating arm extending from the movable link axis and having an outer end;

a drive lever pivoted at a fixed drive axis on the housing and having an outer end pivoted at an outer drive axis on the outer end of the actuating arm of the main lever, the axes all being generally parallel; and drive means for oscillating the drive lever about the fixed drive axis and thereby moving the pusher block generally through a 0°–90° sinusoidal trajectory between an upper point above and spaced horizontally from the blank in the station and a lower point pressing the outer flap against the glue flap of the blank in the station.

2. The box-closing apparatus defined in claim 1 wherein the pusher block has a rounded edge engageable with the outer flap of the box in the station.

3. The box-closing apparatus defined in claim 1 wherein the pusher block has a width generally equal to a width of the outer flap.

4. The box-closing apparatus defined in claim 1 wherein the fixed link axis is above the movable link axis and the fixed drive axis is below the outer drive axis.

5. The box-closing apparatus defined in claim 1, further comprising means including an applicator lever pivoted about an applicator-lever axis on the housing for applying glue to the glue flap.

6. The box-closing apparatus defined in claim 5 wherein the drive means includes a variable-stroke linear servomotor connected to the drive lever.

7. The box-closing apparatus defined in claim 5 wherein the drive means includes a variable-stroke linear servomotor connected to the applicator lever.

8. The box-closing apparatus defined in claim 5 wherein the drive means is coupled to the applicator lever to pivot it about the applicator-lever axis synchronously with pivoting of the drive lever about the fixed drive axis.

9. The box-closing apparatus defined in claim 8 wherein the drive has a cam with a pair of cam formations respectively connected to the drive lever and applicator lever.

10. The box-closing apparatus defined in claim 9 wherein the cam is pivotal about a cam axis and one of the cam formations is a radially open annular groove coupled to the drive lever.

11. The box-closing apparatus defined in claim 9 wherein the drive lever has an arm projecting from the fixed drive axis and the drive means includes a cam follower riding in the respective cam formation and fixable at any of a plurality of locations along the drive-lever arm.

12. The box-closing apparatus defined in claim 9 wherein the cam is pivotal about a cam axis and one of the cam formations is an axially open groove coupled to the applicator lever.

* * * * *